US005090667A

United States Patent [19]

Harrell

[11] Patent Number: 5,090,667

[45] Date of Patent: Feb. 25, 1992

[54] COLLAPSIBLE MOBILE BASE FOR CABLE HOISTS

[75] Inventor: Jerry J. Harrell, Conroe, Tex.

[73] Assignee: Summer Mfg. Co., Inc., Houston, Tex.

[21] Appl. No.: 621,048

[22] Filed: Dec. 3, 1990

[51] Int. Cl.[5] ..... B66D 3/00

[52] U.S. Cl. ..... 254/326; 254/387

[58] Field of Search ..... 254/2 R, 2 C, 4 R, 4 C, 254/325, 326, 327, 335, 336, 387, 323; 280/47.2, 47.29, 641

[56] References Cited

U.S. PATENT DOCUMENTS

| | | | |
|---|---|---|---|
| 1,316,239 | 9/1919 | Hogander | 280/47.29 X |
| 2,120,637 | 6/1938 | Van Doorne | 254/325 X |
| 2,544,220 | 3/1951 | Concklin | 280/641 |
| 2,711,803 | 6/1955 | Hurst | 254/326 X |
| 2,808,160 | 10/1957 | La Londe | 254/327 X |
| 2,812,951 | 11/1957 | Hanson | 254/2 R |
| 2,877,047 | 3/1959 | Weil | 280/641 X |
| 2,983,474 | 5/1961 | Hanna | 254/387 X |
| 3,223,199 | 12/1965 | Schwehr | 254/387 X |
| 3,241,852 | 3/1966 | Muller et al. | 280/47.29 X |
| 3,704,799 | 12/1972 | Morris, Jr. | 280/47.29 X |
| 3,794,296 | 2/1974 | Hasstedt | 254/335 X |
| 4,917,392 | 4/1990 | Ambasz | 280/47.29 X |

FOREIGN PATENT DOCUMENTS

| | | | |
|---|---|---|---|
| 8800111 | 8/1989 | Netherlands | 254/2 R |
| 503818 | 4/1976 | U.S.S.R. | 254/2 R |

*Primary Examiner*—Katherine Matecki
*Attorney, Agent, or Firm*—James L. Jackson

[57] ABSTRACT

A portable cable hoist mechanism is provided which incorporates a wheel mounted base structure having base legs that are capable of being unlocked and folded or otherwise moved to an out-of-the-way position for storage or handling. The base forms a framework to which the extendible base legs are movably secured. Latch members fixed to each of the base legs are projected through latch receptacles in the base framework when the base legs are fully extended. Locking elements establish locking engagement with the respective latch elements to secure the base legs at the extended positions thereof.

20 Claims, 4 Drawing Sheets

FIG.3
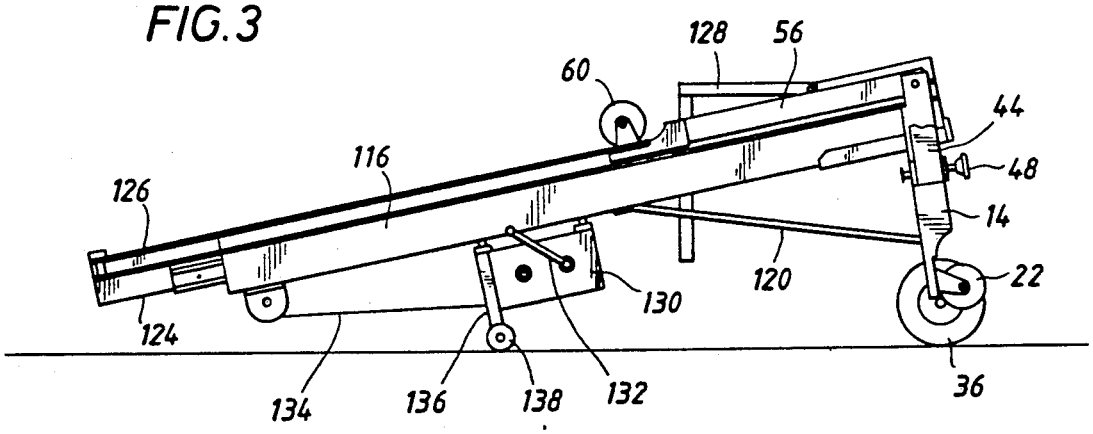
FIG.7
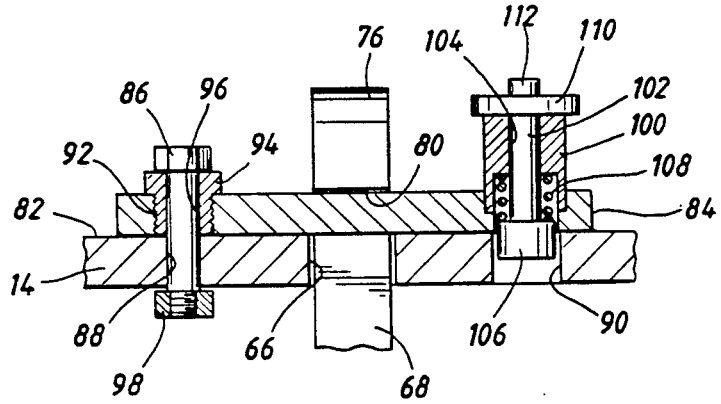
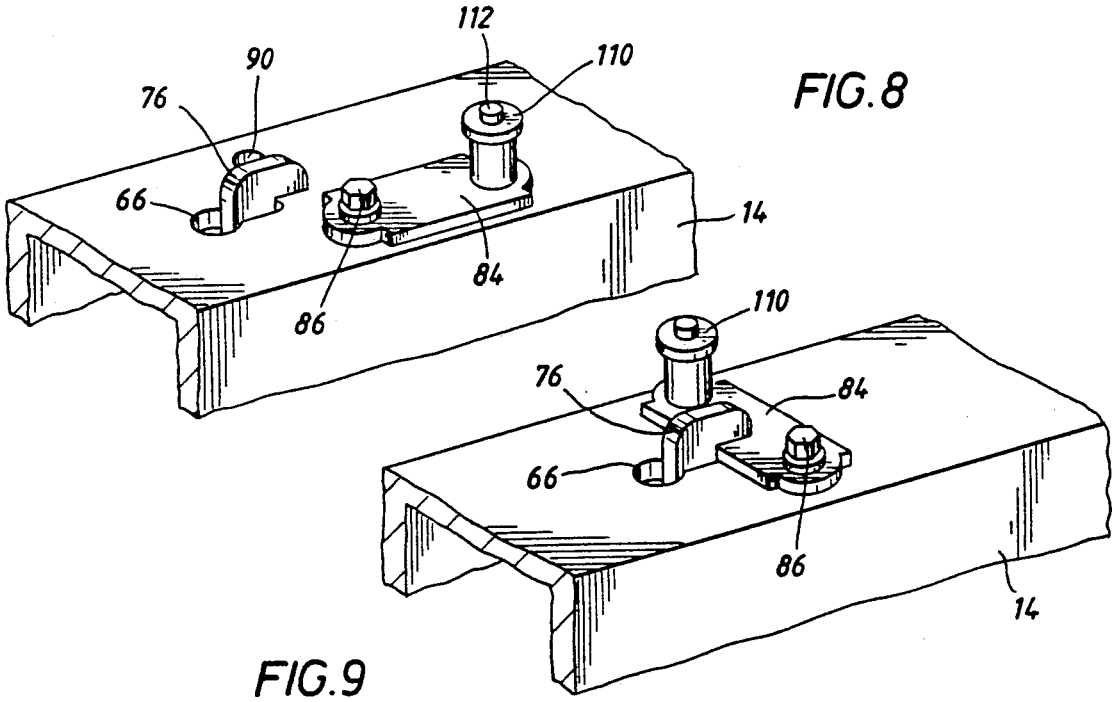
FIG.8
FIG.9

62
60
58
56
50
55
54
116
53
52
46
74
66
76
68
114
78
110
70
86
84
48
40
18
118
120
44
43
42
14
12
20
16
28
26
32
30
34
24
22
38
36

COLLAPSIBLE MOBILE BASE FOR CABLE HOISTS

FIELD OF THE INVENTION

This invention relates generally to hoisting mechanisms and more particularly to portable hoisting mechanisms incorporating a plurality of telescoping masts for lifting and positioning loads to significant heights and which apparatus incorporates a base structure which is sufficiently large to provide good stability. The base structure is capable of being collapsed to a reduced dimension to form a significantly small package for efficient handling, storage and transportation.

BACKGROUND OF THE INVENTION

Various cable hoist devices have been developed over the years which incorporate a plurality of telescopically arranged masts which are capable of being elevated to substantial heights for lifting loads. One such such extensible hoist is set forth in U.S. Pat. No. 3,337,187 of J. D. Sumner. Another three masted cable hoist is set forth in U.S. Pat. No. 4,508,316 of Millard. These cable hoist mechanisms incorporate fixed base structures of fairly large dimension to facilitate efficient stability during lifting operations.

Most cable hoist mechanisms that are capable of extending multiple masts to significant heights are provided with relatively large support bases which are typically wheel mounted to render the apparatus movable on support surfaces such as the floors of buildings. Although these types of cable hoists are suitable for the purposes intended, their large bases, though rendering them safe, typically prevent them from being sufficiently portable so that they can be hauled in small vehicles and efficiently stored and handled in small spaces. Accordingly, it is considered desirable to provide a cable hoist mechanism having a large base structure providing the hoist with efficient stability for safe extension to significant heights and wherein the base is capable of being collapsed to a structure of sufficiently small dimension that the cable hoist can be easily handled, stored and transported.

SUMMARY OF THE INVENTION

It is a principle feature of the present invention to provide a novel cable hoist mechanism incorporating a base structure having movable base components that are capable of being moved from an extended position to a collapsed position for ease of transportation and handling and are capable of being positioned and locked in extended manner to provide a large base structure for adequate stability during support and elevation of the load to be lifted by the hoist mechanism.

It is another feature of this invention to provide a simple and effective locking mechanism for the extendible legs of the mobile base of a cable hoist mechanism.

It is an even further feature of this invention to provide a novel telescoping mast cable hoist mechanism having a collapsible base that is designed to provide the user with the capability of visually inspecting the leg locking mechanisms to insure that the same are positively locked as desired.

Briefly, the invention relates to a mobile base structure for a cable hoist mechanism which is capable of assuming an extended position for stability of the hoist and selectively assuming a contracted condition to render the hoist mechanism easy to store and transport.

According to the present invention, the wheel mounted base structure is provided with movably mounted base legs which are selectively positionable at extended and collapsed positions and which incorporate locking mechanisms enabling the same to be locked in the extended positions thereof to form a large and stable mobile base for the cable hoist mechanism. In one suitable embodiment of the invention, the base legs are capable of being unlocked and pivoted to a collapsed position to thereby allow the base to be as small as possible for efficient storage and handling. The base legs are provided with a simple and efficient latch mechanism having latching and locking components that are sufficiently visually exposed to allow the latch to be visibly inspected to thereby insure that the legs are positively locked in the extended positions thereof.

The collapsible mobile base structure is not restricted to any particular kind of hoist but it is especially effective when employed in conjunction with multi-mast cable hoists. For example the mobile base of this invention is especially applicable to hoists incorporating two, three or four masts. In one embodiment of this invention a bottom mast is fixed in upstanding relation to a wheel mounted base structure and forms an internal mast receptacle and external carriage guide means extending substantially along the entire length of the bottom mast. An intermediate mast is provided which is movably received in telescoping relation within the mast receptacle of the bottom mast. The intermediate mast also forms a mast receptacle capable of receiving the top mast in telescoping relation therein. The top mast is provided with a carriage housing assembly that is fixed at its upper end. A carriage assembly including support means such as a load support fork thereon for supporting a load is movably receivable in guided relation by carriage guide tracks of the bottom mast for guided movement along the length of the bottom mast. The carriage assembly is also receivable in nested, secured relation with the carriage housing assembly of the top mast.

A winch is fixed externally of the bottom mast, intermediate the length thereof, and incorporates a single cable drum and drum drive mechanism which may be actuated manually or by means of any suitable motor mechanism. About the cable drum of the winch assembly is wound a single lift drive and load support cable which is extended sequentially about the first cable pulleys of the bottom mast, the top mast and the carriage assembly. The dead end of the cable is fixed to the upper end of the upper mast or to the carriage housing assembly as desired. A bottom mast is fixed in upstanding relation to a wheel mounted base structure and forms an internal mast receptacle and external carriage guide means extending substantially along the entire length of the bottom mast. An intermediate mast is provided which is movably received in telescoping relation within the mast receptacle of the bottom mast. The intermediate mast also forms a mast receptacle capable of receiving the top mast in telescoping relation therein. The top mast is provided with a carriage housing assembly that is fixed at its upper end. A carriage assembly including support means such as a load support fork thereon for supporting a load is movably receivable in guided relation by carriage guide tracks of the bottom mast for guided movement along the length of the bottom mast. The carriage assembly is also receivable in nested, secured relation with the carriage housing assembly of the top mast.

A winch is fixed externally of the bottom mast, intermediate the length thereof and incorporates a single cable drum and drum drive mechanism which may be actuated manually or by means of any suitable motor mechanism. About the cable drum of the winch assembly is wound a single lift drive and load support cable which is extended sequentially about the first cable pulleys of the bottom mast, the top mast and the carriage assembly. The dead end of the cable is fixed to the upper end of the upper mast or to the carriage housing assembly as desired.

In the case of a typical three masted cable hoist, when the single cable is actuated through driving rotation of the winch drum, initial cable movement will induce movement of the carriage assembly in guided relation along the length of the bottom mast where it is moved transitionally from the bottom mast to the carriage housing of the top mast where it is received in nested relation with the carriage housing assembly of the top mast. The intermediate and top masts will remain stationary during such movement. Upon continued rotation of the winch drum the cable will induce telescoping extension of the top mast. Telescoping movement of the top mast will continue until maximum extension of the top mast will have occurred. Further lifting movement of the winch cable will then induce upward telescoping movement of the intermediate mast which can be continued until the load support carriage is located at its upper mos elevated position. Opposite rotation of the winch drum will first allow the telescoping intermediate and top masts to descend to fully telescoped relation within the bottom mast. Thereafter, continued rotation of the winch drum will allow the carriage assembly to be unlocked from its secured relation with the carriage housing assembly and to move from its nested relation with the carriage housing assembly downwardly in guided relation along the length of the bottom mast to the lowermost position of the load support carriage assembly.

According to another embodiment of the invention a bottom mast is fixed to the mobile base structure and angulated slightly rearwardly in respect to the vertical. For example, the bottom mast may have an angle in the range of 86.5° with respect to the horizontal. The top mast assembly is disposed in telescoping relation over the bottom mast. The top mast and the load supporting carriage assembly are elevated and lowered under the control of a single winch actuated cable.

The carriage housing assembly and carriage assembly are cooperatively provided with a safety latch mechanism which may, if desired, automatically lock the carriage assembly to the carriage housing assembly when nested assembly is established therebetween to secure the carriage in safely locked relation within the carriage housing. This feature ensures transfer of the carriage directly from the carriage housing to the carriage guide tracks of the bottom mast. The latch prevents the carriage from being released from the carriage housing when the masts are telescoped upwardly.

The wheel mounted base structure is provided with pivotally mounted base legs which incorporate locking mechanisms enabling the same to be locked in the extended positions thereof to form a large and stable mobile base for the cable hoist mechanism. The base legs are capable of being unlocked and pivoted (or otherwise moved) to a collapsed position to thereby allow the base to be as small as possible for efficient storage and handling. The base legs are provided with latch openings which each receive a hook-like upper portion of the respective latch therethrough. A locking element is pivotally or otherwise supported by the base framework and is positionable at a locking position in restraining engagement with the latch and an unlocked position clear of the latch. The latch and lock are easily visible at the upper portion of the base framework and thus is easily visibly inspected to thereby insure that the legs are positively locked in the extended positions thereof. The base structure is also provided with pivotal outrigger stabilizers that provide even greater stability for the cable hoist mechanism when the outriggers are extended. In addition to the casters that are provided for mobility of the base in its operative position, the base structure and the bottom mast are provided with additional wheels to thereby permit the cable hoist mechanism to be moved about while lying on its side to thereby provide for movement of the apparatus in confined spaces and for handling and transportation of the lift mechanism by means of small trucks and the like.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is an elevational view of the cable hoist system of FIGS. 1 and 2, illustrating the position of the apparatus in its collapsed position and lying on its side for movement on the lateral wheels thereof.

FIG. 7 is a fragmentary sectional view illustrating in detail the structure of the leg locking mechanism.

FIG. 8 is a fragmentary isometric illustration showing the leg locking mechanism in its unlocked position.

FIG. 9 is a fragmentary isometric illustration similar to that of FIG. 8 but illustrating the leg locking mechanism in its locked position.

DETAILED DESCRIPTION OF THE PREFERRED EMBODIMENT

Figure 1:
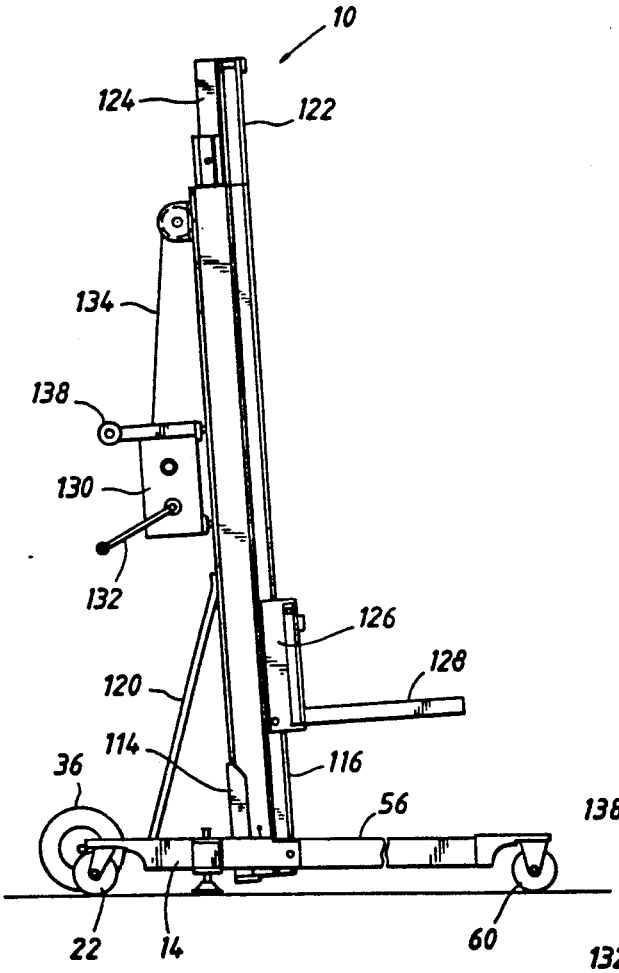
FIG. 1 is an elevational view of a cable hoist mechanism constructed in accordance with the present invention an showing the apparatus in the fully collapsed position thereof.
Figure 2:
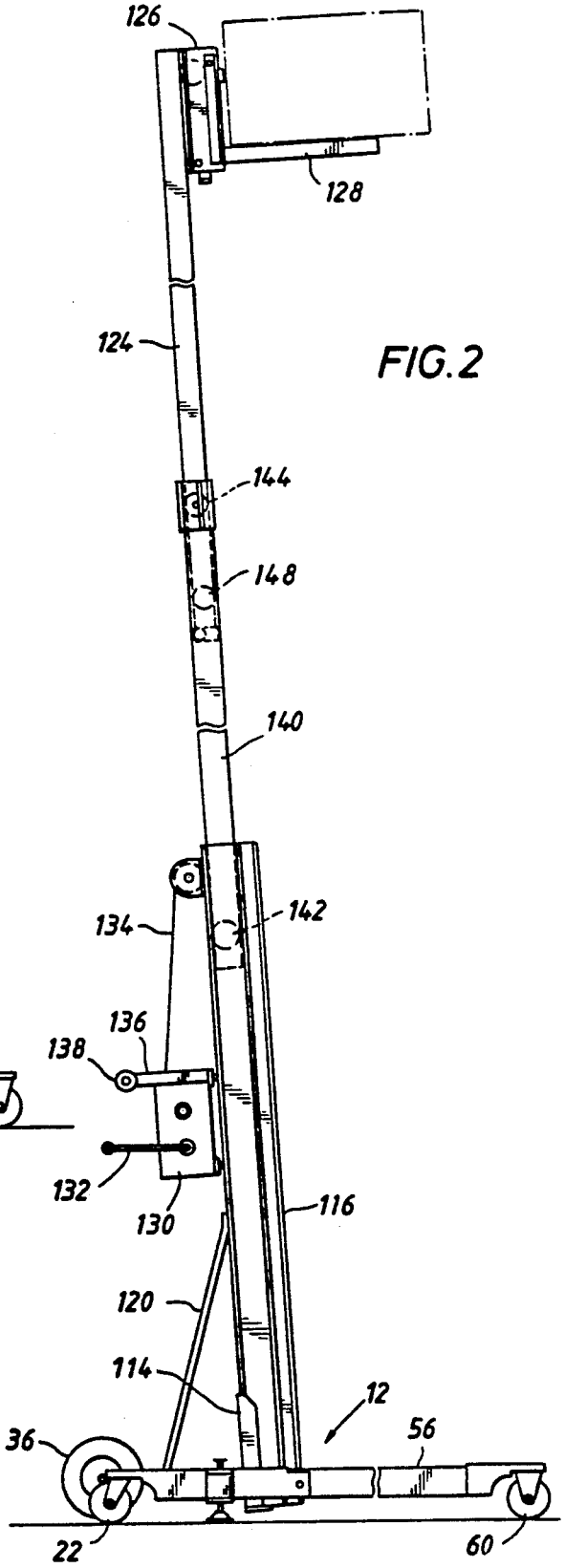
FIG. 2 is an elevational view of the cable hoist mechanism of FIG. 1, showing positioning of the cable hoist mechanism with its masts substantially fully extended.

Referring now to the drawings and first to FIGS. 1, 2, and 3, a cable hoist mechanism constructed in accordance with the present invention is illustrated generally at 10 and is shown at the substantially fully lowered position thereof in FIG. 1 and at the substantially fully extended position thereof in FIG. 2. The apparatus is also shown in its collapsed and side oriented position in FIG. 3 thus adapting it for mobile handling in confined spaces, for transportation by small trucks and for efficient storage.

Figure 4:
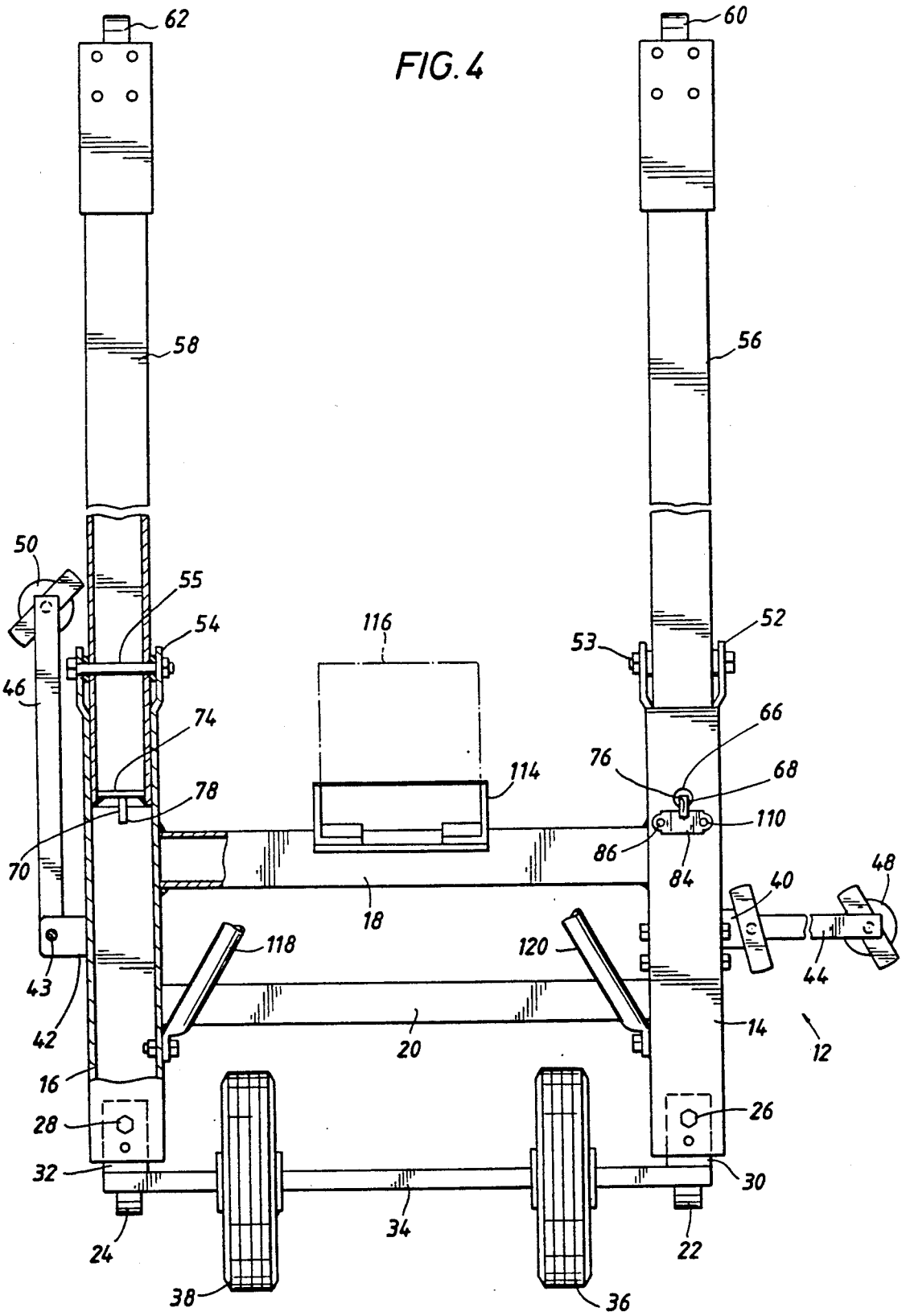
FIG. 4 is a plan view of the base structure of the cable hoist mechanism of this invention having a portion of one of the pivotal leg assemblies thereof broken away and shown in section for illustration of the leg locking mechanism thereof.
Figure 5:
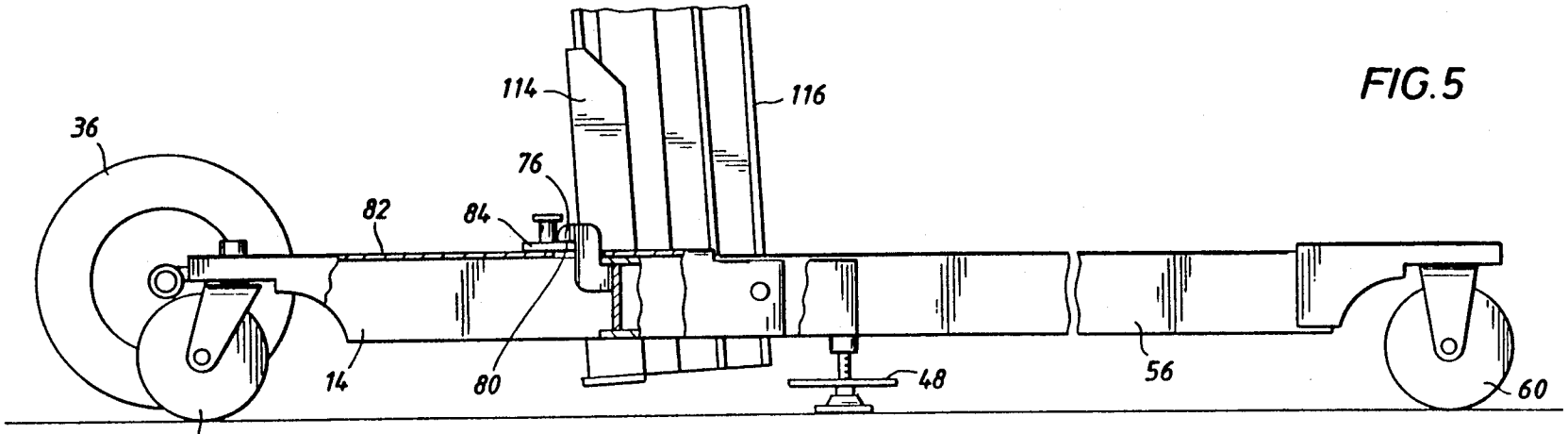
FIG. 5 is an elevational view of the lower portion of the base structure of the cable hoist mechanism having parts thereof broken away and shown in section to show the latch mechanism in its locked position for preventing collapsing movement of the pivotal base legs.
Figure 6:
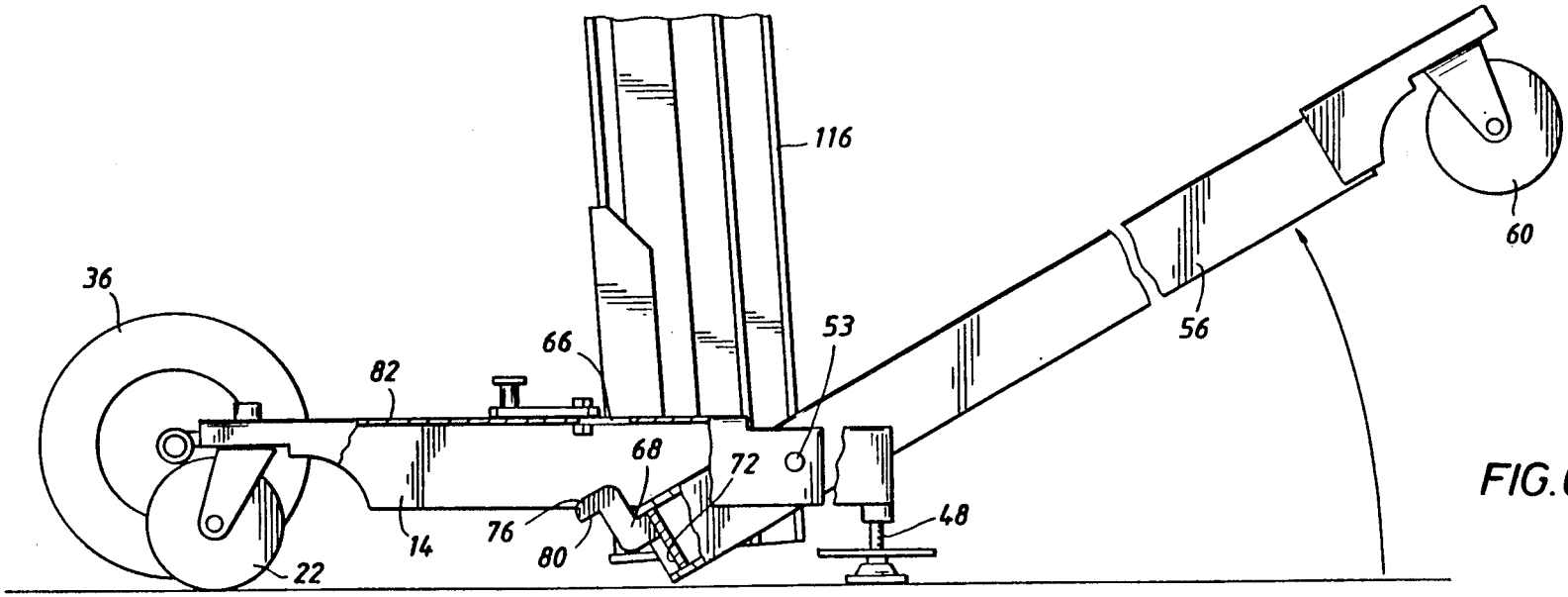
FIG. 6 is an elevational view shown in partial section similar to that of FIG. 5 and illustrating the latch mechanism in the unlatched position thereof and one of the legs unlocked and being pivoted toward its collapsed position.

The cable hoist apparatus incorporates a base structure illustrated generally at 12 which base structure is shown in greater detail in FIGS. 4, 5 and 6. The base structure is formed by a generally rectangular base framework incorporating a pair of generally parallel related structural members 14 and 16 having transverse structural members 18 and 20 interconnected therewith such as by welding. The structural members 14 and 16 may be of tubular form or may be formed by channel members as desired. The structural members may be of rectangular cross-sectional configuration as shown or of any other suitable configuration. At one of the ends thereof, the structural members 14 and 16 provide for support of a pair of casters 22 and 24 by means of any suitable connection. These extremities of the structural members 14 and 16 also provide for support by means of bolts 26 and 28 of lateral wheel support devices 30 and 32 which in turn provide support for a wheel axle 34 upon which lateral wheel assemblies 36 and 38 are mounted. The lateral wheel assemblies provide mobility for the cable hoist apparatus lying at its side supported position thereof as shown in FIG. 3.

A pair of outrigger brackets 40 and 42 are fixed to the structural members 14 and 16 and provide a bolt 43 for pivotal support of a pair of outrigger stabilizer legs 44 and 46 having leveling devices 48 and 50 at the respective free extremities thereof.

At one end of the structural members 14 and 16 is provided pivotal mount assemblies 52 and 54 respectively which provide for pivotal mounting of a pair of collapsible base legs 56 and 58 each having casters 60 and 62 at the respective free extremities thereof. When the cable hoist mechanism is in the operative position thereof for purposes of lifting as shown in FIGS. 1 and 2, it is provided with mobile support by means of wheels or casters 22, 24, 60 and 62.

In one suitable embodiment of this invention, as shown in FIG. 4 the base legs 56 and 58 are pivotally mounted intermediate the extremities thereof to the parallel structural members 14 and 16 thus forming a latching end and a supporting end each being rotatable in arcuate manner about the pivot bolts 53 and 55 of the pivotal mount assemblies. It is to be born in mind that the extendible base legs may be connected in any other suitable extendible and contractible fashion to the base structure of the hoist. As shown in FIG. 4, the base legs 56 and 58 are pivoted to the collapsed positions thereof about the bolts 53 and 55 of the pivot mount assemblies for the purpose of substantially reducing the dimension of the base structure in the manner shown in FIG. 3 to thereby allow the hoist apparatus to be capable of a low profile configuration such that it may be moved about in tight working spaces. In its collapsed condition and lying on its side as shown in FIG. 3, the lift mechanism will easily fit within the bed of a covered pickup truck for ease of transportation.

It is desirable for the purposes of safety to insure that the base legs 56 and 58 are locked in the extended positions thereof such as shown in FIGS. 4 and 5. The pivotal base legs are thus provided with latch mechanisms to ensure their retention at the extended positions thereof. The upper portions of the structural members 14 and 16 are formed to define latch receiving receptacles defined by openings 66.

As shown in FIGS. 4, 5 and 6 latch members 68 and 70 are fixed such as by welding or by another other suitable means of attachment to respective transverse structural members 72 and 74 at the latching ends of the movable base legs 56 and 58. These latch members may also be welded or otherwise fixed to other structural components of the movable base legs if desired. Each of the latch elements define upwardly projecting hook-like portions 76 and 78 as shown in FIG. 4 which, as shown in FIG. 7, define stop surfaces 80 that are positioned in slightly elevated relation above the upper surfaces 82 of the respective structural members 14 and 16 when the base legs are located at the extended positions thereof as shown in FIG. 5. Thus, as the base legs are pivoted from the position shown in FIG. 6 to the position shown in FIG. 5, the hook-like projections 76 of each of the latch members 68 and 70 will be moved through the respective latch openings 66.

For the purpose of securing the respective base legs in the extended positions thereof as shown in FIG. 5, a pair of lock elements 84 in the form of locking plates are supported in movable assembly with the respective parallel structural members 14 and 16 by means of a pivot member 86 such as a bolt. The lock members are thus pivotally movable from an unlocked position to a locked position shown in FIGS. 4, 7 and 9 where the lock element 84 is positioned between the upper surface 82 of the structural members 14 and 16 and the downwardly facing stop shoulder surface 80 of the latch projection 76. In this position the lock member 84 restrains the latch member and the movable leg structure against downward movement relative to the structural members 14 and 16. Thus, in their locked condition, the movable base legs 56 and 58 are prevented from pivoting about their respective pivotal mount assemblies 52 and 54. In this condition, the base legs are locked in the extended positions thereof so as to cooperate with the base structure of the hoist to provide a large stable base that renders the hoist mechanism to a more safe condition for the protection of workers.

Although other lock mechanisms may be employed within the spirit and scope of this invention, the preferred embodiment incorporates a lock mechanism such as shown in detail in the cross-sectional view of FIG. 7 and the operational fragmentary isometric illustrations of FIGS. 8 and 9. The structural members 14 and 16 in addition to forming the latch opening 66, also form a bolt opening 88 and a lock locator or restraint opening 90. In order to establish pivotal mounting of the lock 84 to the respective structural members 14 and 16 the lock element is provided with an opening 92 within which is secured a bushing 94 having a passage 96 through which the stem of the mounting bolt 86 extends in rotatable relation. The mounting bolt also extends through the bolt opening 88 of the structural member and is provided with a lock nut 98 to secure the lock member 84 in its pivotal relation with the respective structural members.

At its opposite extremity, the lock member 84 is provided with an upstanding tubular member 100 which is welded or otherwise secured to the lock member and projects upwardly therefrom. A plunger member 102 extends through the passage 104 of the tubular member and includes an enlargement 106 at its lower end which forms a thrust shoulder for a compression spring 108. The compression spring urges the plunger 102 downwardly and, when the enlargement 106 is located in registry with the lock location opening 90, the lower portion of the plunger will be positioned within the opening 90 thereby securing the lock member 84 against rotation. At its upper end the plunger 102 is provided with a knob 110 which is secured by a retainer 112 to the upper end of the plunger. The knob 110 is sufficiently large that it is easily grasped by a worker. To release the lock from its locked position, the worker will simply apply an upward force to the knob 110 thereby moving the plunger 102 upwardly against the compression of the spring 108. This activity will retract the lower enlargement 106 of the plunger from the lock locator opening 90 thereby freeing the lock member 84 for manual rotation from the locked position as shown in FIG. 9 to the unlocked position as shown in FIG. 8.

After the latch member 68 has been positioned through the latch opening 66 as shown in FIG. 8, the lock member is simply rotated manually about its pivotal bolt 86 thereby positioning the lock between the surface 80 of the latch and the surface 82 of the structural member 14 as shown in FIG. 9. As soon as the lower enlarged portion 106 of the plunger 102 comes into registry with the lock locator opening 90 the compression spring 108 will quickly move the plunger downwardly so that the lower portion of the plunger snaps into the lock locator opening, thus positively securing the lock member 84 at its locked position as shown in FIG. 9.

The user of the cable hoist mechanism will have visual assurance that the latch mechanism, including the latch element 68 and the lock element 84, is in its latched position because these elements are readily visible when the legs 56 and 58 are pivoted to the maximum extended positions thereof. The user is enabled, therefore, to readily inspect the latch mechanism to insure that the pivotal base legs are properly locked.

The transverse structural member 18 of the base framework has a mast support member 114 fixed thereto such as by welding and which provides for support of the lower end of a bottom mast member 116. The mast support 114 is disposed in angulated relation with respect to the plane of the parallel structural members 14 and 16 such that the bottom mast has sufficient rearward tilt that the load supported by the mast structure will develop a force that acts substantially centrally, through the base structure. The cable hoist mechanism will, therefore, not have any tendency to tip over under the influence of a load supported thereby. For additional support of the lower portion of the bottom mast 116, a pair of angled braces 118 and 120 are secured to the respective structural members 14 and 16 by means of bolting such as shown in FIG. 4 and are also bolted or otherwise secured to the rear portion of the bottom mast 116 in the manner shown in FIG. 2.

As shown in FIG. 1 a carriage housing structure 122 is disposed in fixed relation at the upper end of the top mast 124. For support and mobile handling of loads the cable hoist apparatus is provided with a mobile carriage assembly 126 carrying a load support fork 128. In its operative position the load support fork is disposed with its spaced arms in horizontal orientation or inclined slightly upwardly so as to insure positive retention of a load supported thereby.

Intermediate the upper and lower extremities of the bottom mast 116 is provided a cable winch mechanism 130 having a handle 132 for imparting mast lifting and load supporting force to a winch cable 134. The winch housing is provided with a wheel support 136 having a pair of wheels, rollers or casters 138 supported thereby. As shown in FIG. 3, the wheels 138 cooperate with wheels 36 to provide for mobile support of the cable hoist mechanism in the completely lowered condition thereof such as for mobile transport in confined areas and for efficient storage and handling thereof.

As mentioned above, the bottom mast 116 forms a receptacle within which is received an intermediate mast 140 having a cable pulley 142 at its lower end which receives the drive cable 134. At its upper end the intermediate mast 140 is provided with a cable pulley 144. The intermediate mast 140 also defines a receptacle which receives the uppermost mast section 146 in telescoping relation therein. The mast section 124 is provided with a cable pulley 148 at its lower end which also receives the cable 134 in driving relation therewith. As mentioned above, the top mast 124 is provided with a carriage housing 122 which is disposed to receive a load supporting carriage structure 122 in nested relation therein when the top mast is elevated with respect to the intermediate and bottom mast sections.

With the cable hoist mechanism in the fully lowered position and lying on its side as shown in FIG. 3, it is rendered to its compact condition for storage and transportation by moving the lock member 84 to the unlocked position shown in FIG. 8 to thereby release the leg latch 68 as shown in FIG. 8. This allows the pivotal base legs 56 and 58 to be pivoted upwardly as shown in FIG. 6 to a position that is substantially parallel with the bottom mast 116. Thereafter, by releasing two of the bolts of the lifting fork support, the lifting fork assembly 128 may be then pivoted to a stowed position where its support forks are nested on either side of and in inclined relation with the bottom mast 116 as shown in FIG. 3. The outrigger stabilizer legs will also be pivoted to their respective retracted positions as shown at the left side of FIG. 4. In this condition the apparatus may be stored or transported in its lowered or lying position as shown in FIG. 3 simply by rolling it on the support wheels 36 and 138. It can then be stored in a relatively small space either in the lying position as shown in FIG. 3 or in an upstanding position. The cable hoist unit can be easily transported in a small pick-up truck, including covered pick-ups when fully collapsed as shown in FIG. 3.

In view of the forgoing, it is seen that the present invention is well adapted to attain all of the features hereinabove set forth together with other objects and features which are inherent in the apparatus itself.

While the foregoing is directed to the preferred embodiment it is recognized that the apparatus may take on various other embodiments within the spirit and scope of the invention, the scope hereof is determined by the claims which follow.

What is claimed is:

1. In a portable cable hoist mechanism having a plurality of telescopically related masts and being capable of elevating and supporting a load by means of a cable system, the improvement comprising:

(a) a wheel mounted base structure having a base framework defining at least one aperture forming a latch receptacle;

(b) a pair of base legs each being pivotally mounted by generally horizontally oriented pivot members to said base framework and capable of being pivotally moved from an extended position cooperating with said base framework to form a large stable base and capable of movement to a retracted position where said base legs are at a stowed position disposed in similar orientation relative to said base framework as that of said telescopically related masts;

(c) a latch being fixed to each of said base legs and being received by a respective latch receptacle when said base legs are positioned at said extended position such that a portion of said latch projects through said aperture of said base framework; and (d) a pair of lock elements being pivotally supported by said base framework and being positionable in locking engagement with a respective latch when said base leg is located at said extended position thereof to prevent pivotal movement of said base leg relative to said base framework.

2. The improvement of claim 1, wherein:

(a) said base framework includes parallel side members each defining apertures forming said latch receptacles;

(b) a portion of said latch projecting through said latch receptacle when said base leg is located at said extended position thereof; and (c) said lock element being positionable at a locked position restraining movement of said latch relative to said base framework and being positionable at an unlocked position permitting pivotal movement of said latch along with the respective base leg relative to said base framework.

3. The improvement of claim 2, wherein:

(a) said latch receptacle is defined by apertures formed in said parallel side members of said base framework; and (b) said latch being fixed to said base leg and forming a hook-like projection that extends through said latch receptacle and which is engaged and restrained by a respective one of said lock elements when said base leg is located at said extended position thereof.

4. The improvement of claim 3, wherein:

said lock element comprises a locking plate member being pivotally supported by said base framework adjacent said latch receptacle and being pivotally movable between said locked position in restraining engagement with said hook-like projection of said latch and said unlocked position.

5. The improvement of claim 3, wherein:

(a) said lock element is a locking plate being pivotally supported by said base framework; and (b) means releasably securing said locking plate against movement from said locking position thereof.

6. The improvement of claim 5, wherein:

(a) said base framework defines a pair of latch openings forming said latch receptacle and also defining at least one lock restraint receptacle adjacent each latch opening;

(b) said lock element being pivotally supported by said base framework and being pivotally movable from a locked position in restraining engagement with said latch and an unlocked position clear of said latch; and (c) a movable lock restraint member being provided on said lock element and establishing restraining engagement with said lock restraint receptacle at said locked position of said lock element.

7. The improvement of claim 6, wherein said lock restraint member comprises:

(a) a movable lock restraint plunger being supported by said lock member; and (b) means urging said lock restraint plunger toward a position of interengagement with said lock restraint receptacle, whereby at said locked position of said lock member said lock restraint plunger entering said lock restraint receptacle and preventing pivotal movement of said lock member toward said unlocked position thereof.

8. The improvement of claim 1, wherein:

(a) said base legs being pivotally supported intermediate the extremities thereof by said base structure and forming a latching extremity being movable arcuately about said pivotal support, said latching extremity of said base legs having said latch fixed thereto and positioned for projection through said latch receptacle;

(b) said lock means being pivotally supported by said base structure and being pivotally movable between a locked position in restraining engagement with said latch and an unlocked position clear of said latch; and (c) means restraining said lock against movement from said unlocked position thereof.

9. The improvement of claim 8, wherein:

(a) said latch forms a hook-like element projecting through said latch receptacle when said base leg is located at said extended position thereof; and (b) said lock element being a locking plate, pivotally mounted to said base framework and engaging said hook-like element at said locked position thereof and restraining pivotal movement of said latch and said base leg.

10. The improvement of claim 9, including:

a lock restraint plunger being provided on said locking plate and establishing restraining engagement with said latch receptacle when said base leg is located at said extended position thereof to releasably secure said locking plate at said locking position.

11. An expandable and contractible base mechanism for portable cable hoists having a telescoping mast, comprising:

(a) a base framework defining at least one aperture forming a latch receptacle;

(b) at least one base leg being movably mounted by a generally horizontally oriented pivot to said base framework and capable of being pivotally moved from an extended position cooperating with said base framework to form a base of predetermined dimension to a retracted position of smaller dimension as compared to said predetermined dimension, at said retracted position said base leg being positioned in similar orientation with said base framework as said telescoping mast;

(c) a latch member being fixed to said base leg and having a portion thereof positioned to be received through said aperture of said latch receptacle when said base leg is positioned at said extended position; and (d) a lock member being movably supported by said base framework and being positionable in locking engagement with said latch when said base leg is located at said extended position thereof.

12. The expandable and contractible base mechanism of claim 11, wherein:

(a) said base framework includes parallel side members each defining said latch receptacle;

(b) a portion of said latch projecting through said latch receptacle when said base leg is located at said extended position thereof; and (c) said lock member being positionable at a locked position restraining movement of said latch relative to said base framework and being positionable an unlocked position permitting movement of said latch relative to said base framework.

13. The expandable and contractible base mechanism of claim 12, wherein:

(a) said latch receptacle is defined by apertures formed in said parallel side members of said base framework; and (b) said latch defines a hook-like projection that extends through said latch receptacle and is engaged and restrained by said lock member when said base leg is located at said extended position.

14. The expandable and contractible base mechanism of claim 13, wherein:

(a) said hook-like projection forms a restraint shoulder; and (b) said lock member comprises a plate member being pivotally supported by said base framework adjacent said latch receptacle and being pivotally movable between said locked position and said unlocked position, at said locked position said plate member being interposed between said base framework and said restraint shoulder.

15. The expandable and contractible base mechanism of claim 13, wherein:

(a) said lock member is a locking plate being pivotally supported by said base framework; and (b) means releasably securing said locking plate at said locked position thereof.

16. The expandable and contractible base mechanism of claim 15, wherein:

(a) said base framework defines a pair of latch openings forming said latch receptacle and also defining at least one lock restraint receptacle adjacent each latch opening;

(b) said lock member being pivotally supported by said base framework and being pivotally movable from a locked position in restraining engagement with said latch and an unlocked position clear of said latch means; and (c) a movable lock restraint member being provided on said lock member and establishing restraining engagement with said lock restraint receptacle at said locked position of said lock member.

17. The expandable and contractible base mechanism of claim 16, wherein said lock restraint member comprises:

(a) a movable lock restraint plunger being supported by said lock member; and (b) means urging said lock restraint plunger toward a position of interengagement with said lock restraint receptacle, whereby at said locked position of said lock member said lock restraint plunger preventing pivotal movement of said lock member toward said unlocked position thereof.

18. The expandable and contractible base mechanism of claim 11, wherein:

(a) said base leg means being pivotally supported intermediate the extremities thereof by said base framework and forming a latching extremity being movable arcuately during pivotal movement of said base leg means, said latching extremity of said base leg means having said latch fixed thereto and positioned for projection through said latch receptacle;

(b) said lock member being pivotally supported by said base framework and being pivotally movable between a locked position in restraining engagement with said latch means and an unlocked position clear of said latch means; and (c) means restraining said lock member against movement from said unlocked position thereof.

19. The expandable and contractible base mechanism of claim 18, wherein:

(a) said latch forms a hook-like element projecting through said latch receptacle when said base leg is located at said extended position thereof; and (b) said lock member being a locking plate, pivotally mounted to said base framework and engaging said hook-like element at said locked position thereof and restraining pivotal movement of said latch and said base leg relative to said base framework.

20. The expandable and contractible base mechanism of claim 19, including:

a lock restraint plunger being provided on said locking plate and establishing restraining engagement with said latch receptacle when said base leg is located at said extended position thereof to releasably secure said locking plate at said locked position.

* * * * *